United States Patent [19]

Schmahl et al.

[11] Patent Number: 4,870,674

[45] Date of Patent: Sep. 26, 1989

[54] X-RAY MICROSCOPE

[75] Inventors: Günter Schmahl, Göttingen; Dietbert Rudolph, Nordheim, both of Fed. Rep. of Germany

[73] Assignee: Carl-Zeiss-Stiftung, Heidenheim/Brenz, Fed. Rep. of Germany

[21] Appl. No.: 130,755

[22] Filed: Dec. 9, 1987

[30] Foreign Application Priority Data

Dec. 12, 1986 [DE] Fed. Rep. of Germany ..... 3642457

[51] Int. Cl.[4] ..... G21K 7/00

[52] U.S. Cl. ..... 378/43; 378/84

[58] Field of Search ..... 378/43, 84.2, 145; 350/509, 510

[56] References Cited

U.S. PATENT DOCUMENTS 4,105,289 8/1978 Hershel .

FOREIGN PATENT DOCUMENTS 0049300 3/1985 Japan ..... 378/43

OTHER PUBLICATIONS

"Soft X-ray Microscopy at the Hefei Synchrotron Radiation Laboratory", by X. Xie, S. Kang, C. Jia, and T. Jin; Nuclear Instruments and Methods in Physics Research, A 246 (1986), 698–701, North-Holland, Amsterdam, Netherlands.

"Phase Zone Plates for X Ray and the Extreme UV", by Janos Kirz; Journal of the Optical Society of America, vol. 64, No. 3, Mar. 1974.

*Primary Examiner*—Janice A. Howell
*Assistant Examiner*—David P. Porta
*Attorney, Agent, or Firm*—Stonebraker, Shepard & Stephens

[57] ABSTRACT

An x-ray microscope in which the object is illuminated coherently or partially coherently via a condenser with quasi-monochromatic x-radiation and is imaged enlarged in the image plane by a high resolution x-ray objective. To obtain the highest possible image contrast, there is arranged in the Fourier plane of the x-ray objective an element which imparts a phase shift to a preselected order of diffraction of the radiation. The element extends over the surface region in the Fourier plane which is acted on here by the diffracted radiation to be influenced. The utilization of the phase shift of a preselected order of diffraction of the radiation as compared with the uninfluenced radiation makes it possible to carry out examinations, in particular of biological structures, with a low dose of radiation and nevertheless to produce a high image contrast. Moreover, it is possible to shift the wavelength region of the x-ray radiation to be used toward shorter wavelengths at which, as a result of the lesser absorption, x-ray microscopy was not meaningfully possible heretofore.

15 Claims, 1 Drawing Sheet

X-RAY MICROSCOPE

BACKGROUND OF THE INVENTION

This invention relates to x-ray microscopes of the type wherein the object is illuminated coherently or at least partially coherently via a condenser with quasimonochromatic x-radiation, and is imaged enlarged by means of a high-resolution x-ray objective in the image plane. The term "microscope of the type described," as used in this application, means a microscope of this type described above.

Such x-ray microscopes are described, for instance, in Part IV of the book "X-Ray Microscopy" by G. Schmahl and D. Rudolph, published 1984 by Springer-Verlag. Pages 192 to 202 of this book described an x-ray microscope in which each focusing element, and therefore condenser and x-ray objective, is developed as a zone plate. Such a zone plate consists of a plurality of very thin rings, for instance of gold, which are applied on a thin support foil, for instance of polyimide. These rings for a circular grating with radially increasing line density.

The zone plates refract the impinging monochromatic or quasi-monochromatic x-radiation of the wavelength and thus effect an imaging. Quasi-monochromatic radiation means radiation of a certain bandwidth $\Delta\lambda$, this bandwidth being established in connection with zone plates by the relationship $\lambda/\Delta\lambda \approx p.m$, where p=number of lines, and m=number of the order of diffraction still to be covered.

In such known x-ray microscopes, the contrast in the image is obtained by photoelectric absorption in the object, that is, structures are imaged which effect an amplitude modulation of the x-rays passing through.

Particularly suitable is the wavelength range of x-ray radiation between 2.4 nm and 4.5 nm, i.e., between the oxygen K edge and the carbon K edge. This region is also known as the water window, since here water has approximately a ten times higher transmission than organic materials. With it, organic materials can be examined in this wavelength region and thus cells and cell organelles in a living state.

The resolution obtained up to now in x-ray microscopy is better by approximately a factor of ten than in optical microscopy, a further increase in the x-ray microscope resolution by about one order of magnitude being still possible. In this connection, the limiting resolution in the x-ray microscopy of amplitude structures is determined by the radiation load of the objects to be examined.

SUMMARY OF THE INVENTION

It is the object of the present invention to provide an x-ray microscope which makes it possible to carry out examinations, especially examinations of biological structures, with a radiation dose which leads to less radiation load of the objects than the methods previously customary, without having to tolerate any impairment in the image contrast.

Starting from an x-ray microscope of the type described, this object is attained in accordance with the invention by arranging within the Fourier plane of the x-ray objective an element which extends over the surface region acted on by the zero order or by a preselectable different order of the radiation diffracted by the object and imparts a phase shift to the radiation passing through.

In the x-ray microscope according to the invention, phase-shifting properties of object structures are used for the formation of contrast. The phase-shifting element arranged in the beam path imparts to the order of the x-radiation coming from the object which has been preselected by the shape of the element a phase shift with respect to the other radiation coming from the object which does not pass through the element. The phase-shifted portions and the unaffected portions of the radiation interfere in the image plane and thereby produce a high-contrast enlarged image of the object.

It has proven particularly advantageous to impart to the x-radiation of zero order coming from the object a phase shift of 90 degrees with respect to the orders diffracted by the object structures. This can be done in a particularly simple manner since the radiation of zero order illuminates a central circular disk in the Fourier plane of the x-ray objective. An embodiment of the phase-shifting element suitable for this will be described.

The invention proceeds from the discovery that the index of refraction n of an element in the x-ray region is composed of two variables of different action. This can be expresed schematically by the relationship $$n=1-\delta-i\beta.$$

The variable B describes the absorption, which becomes smaller with shorter wavelengths $\lambda$ of the x-radiation. The variable $\delta$ is controlling for the phase shift which is imparted to the x-radiation which passes through. The variable $\delta$ varies in general only very slowly with the wavelength. For this reason, therefore, when utilizing the phase-shift by the object, a definite improvement in the contrast in the image can be obtained.

Thus it is possible, in particular even when using less radiation load of the object, to produce images having contrast at least as good as those obtainable in the past, when utilizing amplitude contrast, only with higher radiation load.

From this consideration, it is seen that there is also a further essential advantage of the x-ray microscope of the present invention. Since the variable $\delta$ changes only slightly with a change in the wavelength $\lambda$, it is possible, with utilization of the phase shift, for the wavelength region of the x-ray radiation to be shifted to shorter wavelengths at which, as a result of the slight absorption (i.e., small $\beta$), x-ray microscopy was heretofore not meaningfully possible in view of the low contrast obtainable in the image.

Under certain circumstances, it may be possible to influence the phase of the x-radiation of higher orders of the radiation diffracted by the object, rather than that of zero order. These orders form rings in the Fourier plane of the x-ray objective, so that the phase shifting element is developed of annular ring form as described below and illustrated in FIG. 4 of the drawings.

As shown by the above formula for the index of refraction n, an absorbing action also always takes place with a phase shift. This applies, of course, also to the phase-shifting element used in the x-ray microscope of the present invention. Therefore it may be necessary to make the intensities of the orders interfering in the image plane of the radiation coming from the object equal to each other.

For this purpose, the phase-shifting action and the absorbing action of the phase-shifting element are advantageously distributed over different corresponding surfaces in the Fourier plane of the x-ray objective. The radiation passing through these corresponding surfaces is affected in phase and in amplitude independently from each other, in such manner that the intensities of the orders of the radiation which interfere in the image plane are made equal to each other.

BRIEF DESCRIPTION OF THE DRAWINGS

The invention will now be described in further detail with reference to the accompanying drawings, in which.

DETAILED DESCRIPTION

Figure 1:
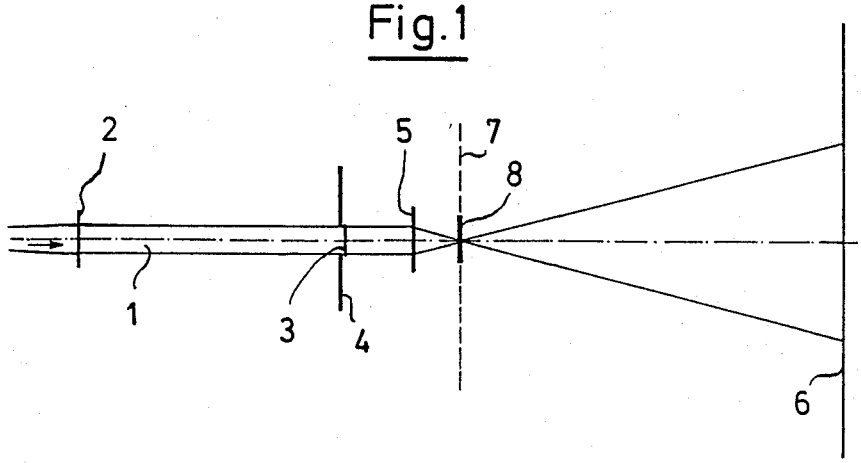
FIG. 1 shows schematically an illustrative embodiment of the construction in principle of an x-ray microscope according to the invention.

In FIG. 1, the radiation coming from a source of x-rays is indicated at 1. A known or conventional source of x-rays can be employed, such as a synchrotron or another source described in Part I of the above-mentioned book "X-Ray Microscopy" by Schmahl and Rudolph, 1984.

The x-radiation passes through an x-ray condenser 2, and is directed by this condenser to the object 3 which is to be observed and which is arranged on a central aperture 4. The x-radiation diffracted by the object 3 passes through a high resolution x-ray objective 5 and is imaged thereby in the image plane 6.

The Fourier plane of the objective 5 is indicated at 7. In this plane, the radiation passing through the object 3 is broken down into harmonic Fourier components. In the image plane 6 this distribution is represented by Fourier retransformation as a real image.

Figure 2:
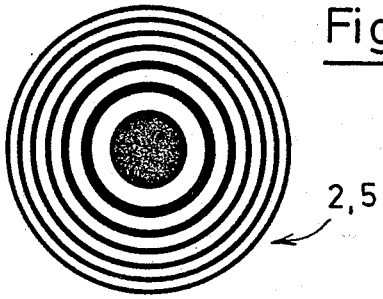
FIG. 2 is a plan view of a zone plate used as an imaging element.

For the imaging elements 2 and 5, it is advantageous to use zone plates such as shown by way of example in FIG. 2. This zone plate consists of a plurality of rings arranged concentrically on a very thin support foil, for instance of polyimide. The rings normally consist of gold or chromium, and have a small thickness of about 0.1 μm. The rings form a circular grating with radially increasing line density.

Figure 3:
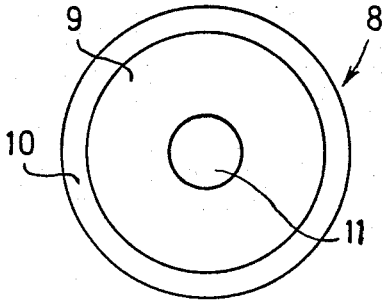
FIG. 3 is a plan view of the phase-shifting element contained in the microscope of FIG. 1.

In the Fourier plane 7 of the objective 5 there is a phase-shifting and/or absorbing element 8. As shown in FIG. 3, it consists of a thin support foil 9 which is mounted in a ring 10 and on which there is applied a thin layer of phase-shifting material, for instance chromium, in the form of a central circular disk 11.

As can be noted from FIG. 1, the x-radiation of zero order coming from the object 3 passes through the central circular disk 11. The disk material 11 imparts a phase shift of 90 degrees to this radiation as compared with the orders diffracted by the object structures. In the image plane 6, interference is produced between the phase-shifted radiation and the unaffected radiation, and there is thus produced a high-contrast enlarged image of the object 3 which can be recorded directly, for instance on a photosensitive layer.

If one employs, for instance, x-radiation of a wavelength λ of 4.5 nm and if the central circular disk 11 of the element 8 is a chromium layer having a thickness of 0.09 μm, then a protein structure having a thickness of 10 nm in water supplies, with the x-ray microscope of FIG. 1, approximately twenty times better contrast than the previously customary imaging in the amplitude contrast.

Figure 4:
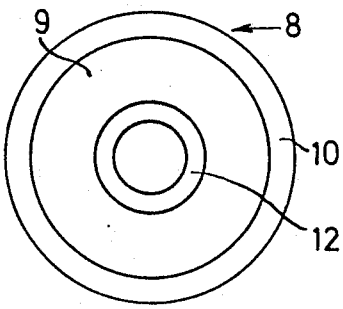
FIG. 4 is a plan view of another embodiment of the phase-shifting element.

FIG. 4 illustrates an embodiment for an element 8 serving for the phase shifting and/or absorption, in which a ring 12 of suitable material, e.g. chromium, is applied on the support foil 9. This ring imparts a phase shift to higher orders of the radiation diffracted by the object. What order is to be affected is determined by the diameter and the width of the ring 12. The chromium of the ring 12 may be of the same thickness above mentioned as the thickness of the chromium disk 11 in FIG. 3, and the supporting foil 9 in FIG. 4 may be of the same material as the supporting foil 9 in FIG. 3 and the supporting foil in FIG. 2.

What is claimed is:

1. An x-ray microscope in which an object to be examined is illuminated at least partially coherently via a condenser with quasi-monochromatic x-radiation and is imaged enlarged in an image plane by means of a high-resolution x-ray objective, each said condenser and said objective being formed by a zone plate consisting of a plurality of rings arranged concentrically on a support foil, said objective having a Fourier plane situated between said objective and said image plane, said microscope comprising phase shifting means arranged in said Fourier plane and formed by a foil which carries object structures of a preselected shape corresponding to the shape of a preselected order of the x-radiation diffracted by said object and imaged in said Fourier plane, the object structures of said phase shifting means imparting a phase shift to said radiation diffracted by said object on its way to said image plane, whereby contrast of an image of said object produced at said image plane is enhanced.

2. An x-ray microscope as defined in claim 1, wherein said pre-selected order of radiation acted upon by said phase shifting means is the zero order.

3. An x-ray microscope as defined in claim 1, wherein said phase shifting means comprises a phase shifting and absorbing element.

4. An x-ray microscope as defined in claim 1, wherein said phase shifting means comprises an element having both a phase shifting action and an absorbing action, and wherein said phase shifting action and said absorbing action are distributed, for equalizing the intensities of different orders, independently of each other on different corresponding surfaces in said Fourier plane.

5. An x-ray microscope as defined in claim 4, wherein said element comprises a support foil (9) having applied thereto a central circular disk (11) in the form of a layer of such thickness that x-radiation passing through it experiences a phase shift of 90 degrees.

6. An x-ray microscope as defined in claim 5, wherein said central circular disk is so dimensioned and constructed that x-radiation passing through it experiences also an amplitude-adapting absorption.

7. An x-ray microscope as defined in claim 5, wherein said central circular disk consists essentially of a layer of chromium.

8. An x-ray microscope as defined in claim 7, wherein said layer of chromium, when intended for use with x-rays of a wavelength of substantially 4.5 nm, has a thickness of substantially 0.09 μm.

9. An x-ray microscope as defined in claim 4, wherein said element comprises a support foil (9) having applied thereto an annular ring of a layer of material (12) which imparts to impinging radiation of an order whose number is equal to or greater than 1, diffracted by said object, a phase shift.

10. An x-ray microscope as defined in claim 9, wherein said layer of material also imparts to said impinging radiation an amplitude-adapting absorption.

11. An x-ray microscope as defined in claim 9, wherein said layer of material is a layer of chromium.

12. An x-ray microscope as defined in claim 1, wherein said zone plate comprises a plurality of rings arranged concentrically on a support foil, the rings forming a circular grating with radially increasing line density.

13. An x-ray microscope in which the object is illuminated coherently or partially coherently via a condenser with quasi-monochromatic x-radiation and is imaged enlarged in an image plane by means of a high-resolution x-ray objective said condenser and said objective each being formed by a zone plate consisting of a plurality of rings arranged concentrically on a support foil, said objective having a Fourier plane situated between said objective and said image plane, characterized by the fact that in said Fourier plane (7) of the x-ray objective (5) there is arranged phase shifting means including an element (8) which imparts a phase shift to the transversing radiation, said element being formed by a foil which carries ring structures of a preselected shape corresponding to the shape of a preselected order of the x-radiation diffracted by said object and imaged in said Fourier plane, the ring structures of said phase shifting means imparting a phase shift to said radiation diffracted by said object on its way to said image plane, whereby contrast of an image of said object produced at said image plane is enhanced.

14. An x-ray microscope according to claim 13, characterized by the fact that the phase-shifting and absorbing action of the element (8) is distributed, for the equalizing of the intensities of the different orders, independently of each other on the different corresponding surfaces of the Fourier plane (7) of the x-ray objective (5).

15. An x-ray microscope as defined in claim 13, further including a zone plate located in the path of said x-radiation before such radiation reaches said phase shifting means, said one plane comprising a plurality of rings arranged concentrically on a support foil, the rings forming a circular grating with radially increasing line density.

* * * * *